US006908374B2

(12) United States Patent
Wang et al.

(10) Patent No.: US 6,908,374 B2
(45) Date of Patent: Jun. 21, 2005

(54) CHEMICAL MECHANICAL POLISHING ENDPOINT DETECTION

(75) Inventors: Yuchun Wang, Naperville, IL (US); Bernard M. Frey, Berkeley, CA (US); Bulent M. Basol, Manhattan Beach, CA (US); Douglas W. Young, Sunnyvale, CA (US); Homayoun Talieh, San Jose, CA (US); Efrain Velazquez, Los Angeles, CA (US)

(73) Assignee: Nutool, Inc., Milpitas, CA (US)

( * ) Notice: Subject to any disclaimer, the term of this patent is extended or adjusted under 35 U.S.C. 154(b) by 219 days.

(21) Appl. No.: 10/052,475

(22) Filed: Jan. 17, 2002

(65) Prior Publication Data

US 2002/0173225 A1 Nov. 21, 2002

(Under 37 CFR 1.47)

Related U.S. Application Data

(63) Continuation-in-part of application No. 09/684,059, filed on Oct. 6, 2000, now Pat. No. 6,468,139, which is a continuation-in-part of application No. 09/576,064, filed on May 22, 2000, now Pat. No. 6,207,572, which is a continuation of application No. 09/201,928, filed on Dec. 1, 1998, now Pat. No. 6,103,628.

(51) Int. Cl.[7] ..... B24B 49/12
(52) U.S. Cl. ..... 451/296; 451/6; 451/59

(58) Field of Search ..... 451/6, 41, 59, 451/285–287, 290, 296, 301, 307, 398, 168; 438/691–693; 156/345, 345.12

(56) References Cited

U.S. PATENT DOCUMENTS

| | | | | | |
|---|---|---|---|---|---|
| 5,605,760 | A | | 2/1997 | Roberts | 428/409 |
| 6,025,015 | A | * | 2/2000 | Landry-Coltrain et al. | 427/130 |
| 6,146,248 | A | * | 11/2000 | Jairath et al. | 451/41 |
| 6,241,583 | B1 | * | 6/2001 | White | 451/41 |
| 6,244,935 | B1 | * | 6/2001 | Birang et al. | 451/41 |
| 6,248,000 | B1 | * | 6/2001 | Aiyer | 451/41 |
| 6,261,959 | B1 | * | 7/2001 | Travis et al. | 438/692 |
| 6,406,363 | B1 | * | 6/2002 | Xu et al. | 451/296 |
| 6,475,070 | B1 | * | 11/2002 | White | 451/59 |

* cited by examiner

*Primary Examiner*—Joseph J. Hail, III
*Assistant Examiner*—David B. Thomas
(74) *Attorney, Agent, or Firm*—Pillsbury Winthrop LLP

(57) ABSTRACT

The methods and systems described provide for an in-situ endpoint detection for material removal processes such as chemical mechanical processing (CMP) performed on a workpiece. In a preferred embodiment, an optical detection system is used to detect endpoint during the removal of planar conductive layers using CMP. An optically transparent polishing belt provides endpoint detection through any spot on the polishing belt. Once endpoint is detected, a signal can be used to terminate or alter a CMP process that has been previously initiated.

29 Claims, 3 Drawing Sheets

CHEMICAL MECHANICAL POLISHING ENDPOINT DETECTION

CROSS REFERENCE TO RELATED APPLICATIONS

The present application is a continuation in part of U.S. application Ser. No. 09/684,059, filed Oct. 6, 2000, now U.S. Pat. No. 6,468,139 issued Oct. 22, 2002, entitled "Polishing Apparatus and Method with a Refreshing Polishing Belt and Loadable Housing," the entire contents of which are herein incorporated by reference, and which is a continuation-in part of U.S. application Ser. No. 09/576,064, filed May 22, 2000, now U.S. Pat. No. 6,207,572 issued Mar. 27, 2001, which is a continuation of U.S. application Ser. No. 09/201,928, filed Dec. 1, 1998, now U.S. Pat. No. 6,103,628 issued Aug. 15, 2000.

BACKGROUND OF THE INVENTION

1. Field of the Invention

The present invention relates to manufacture of semiconductor integrated circuits and more particularly to a method of chemical mechanical polishing of conductive layers.

2. Description of the Related Art

Conventional semiconductor devices generally include a semiconductor substrate, usually a silicon substrate, and a plurality of sequentially formed dielectric interlayers such as silicon dioxide and conductive paths or interconnects made of conductive materials. Copper and copper alloys have recently received considerable attention as interconnect materials because of their superior electromigration and low resistivity characteristics. Interconnects are usually formed by filling copper in features or cavities etched into the dielectric interlayers by a metallization process. The preferred method of copper metallization process is electroplating. In an integrated circuit, multiple levels of interconnect networks laterally extend with respect to the substrate surface. Interconnects formed in sequential layers can be electrically connected using vias or contacts. In a typical process, first an insulating layer is formed on the semiconductor substrate. Patterning and etching processes are performed to form features such as trenches and vias in the insulating layer. After coating features on the surface with a barrier and then a seed layer, copper is electroplated to fill the features. However, the plating process, in addition to the filling the features, also results in a copper layer on the top surface of the substrate. This excess copper is called overburden and it should be removed before the subsequent process steps.

FIG. 1A shows an exemplary portion 8 of such plated substrate 9, for example a silicon wafer. It should be noted that the substrate 9 may include devices or other metallic and semiconductor sections, which are not shown in FIG. 1A for the purpose of clarification. As shown in FIG. 1A, vias 10, 12 and a trench 13 are formed in an insulation layer 14, such as a silicon dioxide layer, that is formed on the substrate 9. The vias 10,12 and the trench 13 as well as top surface 15 of the insulation layer 14 are covered and filled with a deposited copper layer 16 through an electroplating process. Conventionally, after patterning and etching, the insulation layer 14 is first coated with a barrier layer 18, typically, a Ta or Ta/TaN composite layer. The barrier layer 18 coats the vias and the trenches as well as the surface of the insulation layer to ensure good adhesion and acts as a barrier material to prevent diffusion of the copper into the semiconductor devices and into the insulation layer. Next a seed layer (not shown), which is often a copper layer, is deposited on the barrier layer. The seed layer forms a conductive material base for copper film growth during the subsequent copper deposition. As the copper film is electroplated, the deposited copper layer 16 quickly fills the vias 10, 12 but coats the wide trench 13 and the top surface 15 in a conformal manner. When the deposition process is continued to ensure that the trench is also filled, a copper layer or overburden is formed on the substrate 9. Conventionally, after the copper plating, various material removal processes, for example, chemical mechanical polishing (CMP), etching or electroetching, can be used to remove the unwanted overburden layer.

The CMP process conventionally involves pressing a semiconductor wafer or other such substrate against a moving polishing surface that is wetted with a polishing slurry. The slurries may be basic or acidic and generally contain alumina, ceria, silica or other hard abrasive ceramic particles. The polishing surface is typically a planar pad made of materials well known in the art of CMP. The polishing slurry may be flowed over the pad or may be flowed through the pad if the pad is porous in the latter case. During a CMP process a wafer carrier with a wafer to be processed is placed on a CMP pad and pressed against it with controlled pressure while the pad is rotated. The pad may also be configured as a linear polishing belt that can be moved laterally as a linear belt. The process is performed by moving the wafer against the pad, moving the pad against the wafer or both as polishing slurry is supplied to the interface between the pad and the wafer surface.

As shown in FIG. 1B, CMP is first applied to reduce the thickness of the copper layer down to the barrier layer 18 that covers the top surface 15 of the insulation layer 14. Subsequently, the barrier layer 18 on the top surface is removed to confine the copper and the remaining barrier in the vias 10, 12 and trenches 13. However, during these processes, determining the polishing endpoint, whether the copper layer is polished down to the barrier layer or the barrier layer is polished down to the insulation layer, is one of the important problems in the industry.

U.S. Pat. No. 5,605,760 describes a polishing pad that is made of solid uniform polymer sheet. The polymer sheet is transparent to light at a specified wavelength range. The surface of the polymer sheet does not contain any abrasive material and does not have any intrinsic ability to absorb or transport slurry particles.

More recently, endpoint detection systems have been implemented with rotating pad or linear belt systems having a window or windows in them. In such cases as the pad or the belt moves, it passes over an in-situ monitor that takes reflectance measurements from the wafer surface. Changes in the reflection indicate the endpoint of the polishing process. However, windows opened in the polishing pad can complicate the polishing process and may disturb the homogeneity of the pad or the belt. Additionally, such windows may cause accumulation of polishing byproducts and slurry.

Therefore, a continuing need exists for a method and apparatus which accurately and effectively detects an endpoint on a substrate when the substrate is polished using CMP processes.

SUMMARY OF THE INVENTION

The present invention advantageously provides an in-situ method and apparatus for performing endpoint detection for material removal processes such as CMP.

A chemical mechanical polishing (CMP) apparatus for polishing a surface of a workpiece and for detecting a CMP endpoint is presented according to an aspect of the present invention. The CMP apparatus includes an optically transparent polishing belt, a workpiece holder, a support plate, and an optical detection system. The polishing belt, preferably including abrasive particles, polishes the surface of the workpiece and is movable in one or more linear directions. The workpiece holder supports the workpiece and is configured to press the workpiece against the polishing belt. The support plate is adapted to support the polishing belt as the workpiece is pressed against the polishing belt. The optical detection system detects the CMP endpoint and is disposed below the polishing belt. The optical detection system includes a light source and a detector. The light source sends outgoing signals through the support plate and the polishing belt to the surface of the workpiece. The detector receives incoming reflected signals from the surface of the workpiece through the polishing belt and the support plate.

A method of polishing a surface of a workpiece and of detecting a chemical mechanical polishing (CMP) endpoint is presented according to another aspect of the present invention. According to the method, the workpiece is pressed against an optically transparent polishing belt. The polishing belt is supported by a support plate. The surface of the workpiece is polished with the polishing belt. The polishing belt is movable in one or more linear directions. Outgoing optical signals are sent from a light source through the support plate and the polishing belt to the surface of the workpiece. The light source is disposed below the polishing belt so that the polishing belt is between the light source and the surface of the workpiece. Incoming reflected optical signals are received from the surface of the workpiece through the polishing belt and the support plate at a detector. The detector is disposed below the polishing belt.

A method of polishing one or more workpieces and of providing chemical mechanical polishing (CMP) endpoint detection is presented according to a further aspect of the present invention. According to the method, an optically transparent polishing belt is provided between a supply area and a receive area. The polishing belt has a first end and a second end and a polishing side and a backside. The first end initially comes off the supply area and is connected to the receive area and the second end remains connected to the receive area. A first workpiece is polished by moving a portion of the polishing belt in one or more linear directions within a polishing area. A first CMP endpoint of the first workpiece is detected using an optical detection system. The optical detection system sends outgoing signals to and receives incoming reflected signals from the first workpiece through the polishing belt. The polishing belt is located between the optical detection system and the first workpiece.

A CMP apparatus for polishing a surface of a workpiece and for detecting a CMP endpoint is presented according to another aspect of the present invention. The CMP apparatus includes a supply spool and a receiving spool, an optically transparent polishing belt, a processing area, a means for moving a section of the polishing belt in one or more linear directions, and a means for detecting a CMP endpoint. The polishing belt has two ends. One end is attached to the supply spool and the other end is attached to the receiving spool. The processing area has a section of the polishing belt in between the two ends. The means for detecting the CMP endpoint sends optical signals to, and receives reflected optical signals from, the surface of the workpiece through the polishing belt. The polishing belt is located between the means for detecting and the workpiece.

A method of polishing a surface of a workpiece and of detecting a CMP endpoint is presented according to a further aspect of the present invention. According to the method, the workpiece is supported such that the surface of the workpiece is exposed to a section of an optically transparent polishing belt in a processing area. The surface of the wafer is polished by moving the section of the polishing belt bi-directional linearly. A CMP endpoint is determined for the workpiece by sending outgoing optical signals through the polishing belt to the workpiece and continuously examining the relative intensity of incoming optical signals reflected from the workpiece and received through the polishing belt.

The foregoing discussion of aspects of the invention has been provided only by way of introduction. Nothing in this section should be taken as a limitation on the following claims, which define the scope of the invention.

BRIEF DESCRIPTION OF THE DRAWINGS

The foregoing and other features, aspects, and advantages will become more apparent from the following detailed description when read in conjunction with the following drawings, wherein.

DETAILED DESCRIPTION OF THE PREFERRED EMBODIMENTS

As will be described below, the present invention provides a method and a system for an in-situ endpoint detection for material removal processes such as CMP.

Figure 1A:
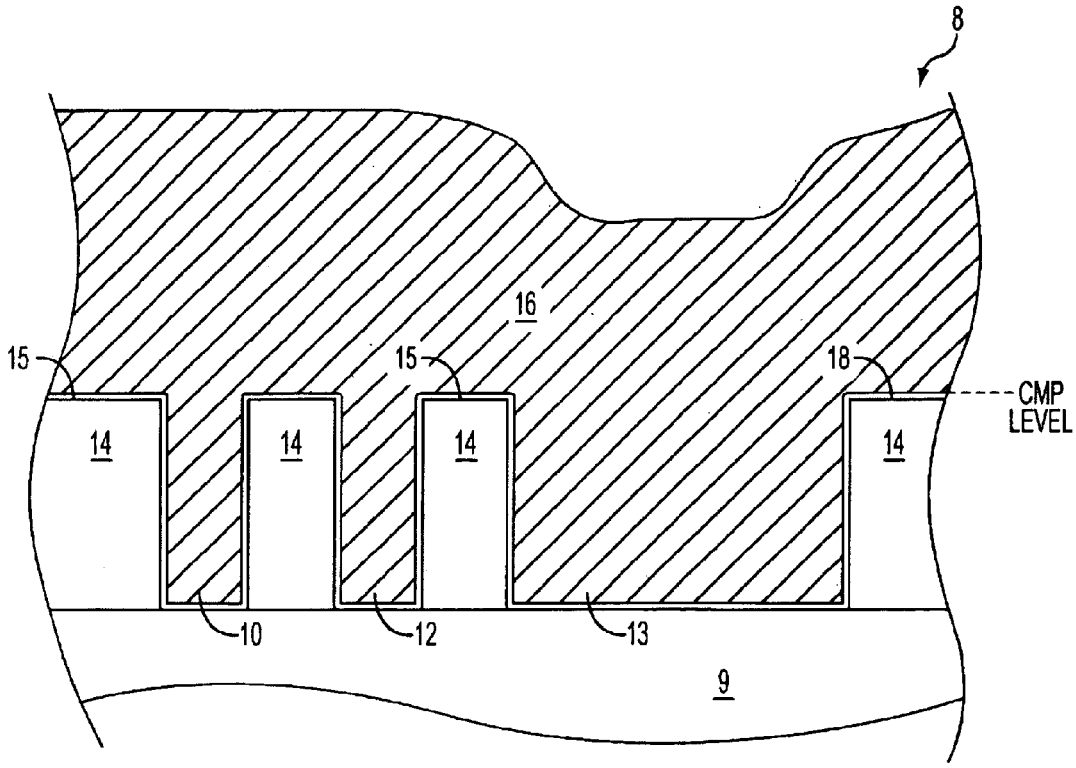
FIG. 1A is a diagram illustrating a cross-sectional view of an exemplary substrate following deposition of material onto the surface of the substrate.
Figure 1B:
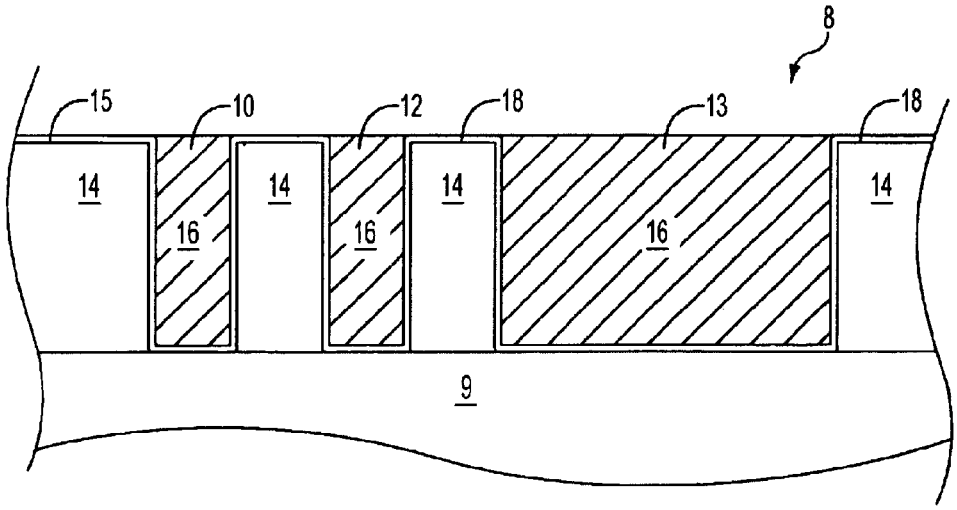
FIG. 1B is a diagram illustrating a cross sectional view of the exemplary substrate of FIG. 1 following a conventional CMP process.
Figure 2:
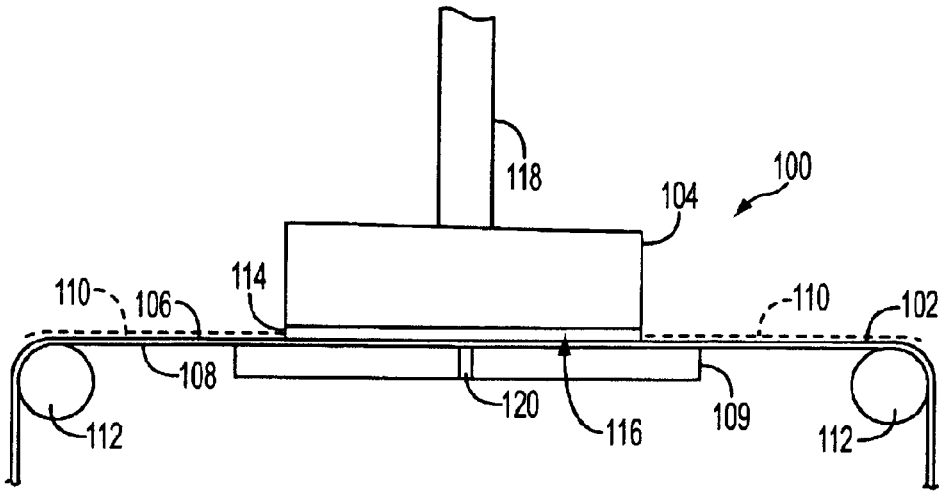
FIG. 2 is a diagram illustrating a cross sectional side view of an exemplary CMP system including an exemplary endpoint detection system according to a presently preferred embodiment used for processing workpieces such as wafers.

Reference will now be made to the drawings wherein like numerals refer to like parts throughout. FIG. 2 shows an exemplary chemical mechanical polishing (CMP) apparatus 100 that includes a polishing belt 102 and a carrier head 104. The belt 102 includes an upper or process surface 106 and a lower surface 108. The lower surface 108 of the belt is placed and tensioned on a support plate 109 such as a platen. In this embodiment, the belt 102 is an optically transparent belt. A polishing solution 110 is flowed on the process surface 106 of the belt 102, and the belt is moved over a set of rollers 112 either in unidirectional or bi-directional manner by a moving mechanism (not shown). In this embodiment, the belt is moved bi-directional manner. The polishing solution 110 may be a copper polishing solution or an abrasive polishing slurry. The solution 110 may be fed from one or both sides of the wafer onto the belt, or it may also be fed onto the wafer surface through the belt, or both. A wafer 114 to be processed is held by the carrier head 104 so that a front surface 116 of the wafer, which will be referred to as surface hereinafter, is fully exposed. The head 104 may move the wafer vertically up and down as well as rotate the wafer 114 through a shaft 118. The surface 116 of the wafer 114 may have the structure shown in FIG. 1A with a copper layer 16 (that includes both the seed layer and the deposited copper) that can be polished down to the barrier layer 18 therebelow (as shown FIG. 1B), while the endpoint detection is performed in-situ using the present invention. In this example, the overburden layer is copper (Cu), the barrier layer 18 is tantalum (Ta) and the insulation layer 14 is silicon dioxide ($SiO_2$). In this embodiment, an endpoint monitoring device 120, preferably comprising an optical emitter and detector, is placed under the belt 102. The endpoint monitoring device 120 detects the polishing endpoint, when the copper layer is polished down to the barrier layer 18 on the top surface 15 of the insulation layer (see FIGS. 1A–1B). As soon as the barrier layer is exposed and detected by the device 120, the process is halted. In an optional step, if desired, the process may be continued until the barrier layer is polished down to the underlying oxide layer. As will be described below, the device 120 may be placed in a cavity in the platen 109. The device 120 of the present invention can be any optical monitoring device that is used to monitor changes in reflectivity. Although copper is used as an example material herein, the present invention may also be used in the removal of other materials, for example conductors such as Ni, Pd, Pt, Au, Pb, Sn, Ag, and their alloys, Ta, TaN, Ti and TiN, as well as insulators and semiconductors. During the process, the wafer 114 is rotated and the surface 116 is contacted by the process surface 106 of the belt 102 that is moved while the polishing solution 110 is flowed on the process surface 106 and wets the surface 116 of the wafer.

Figure 3:
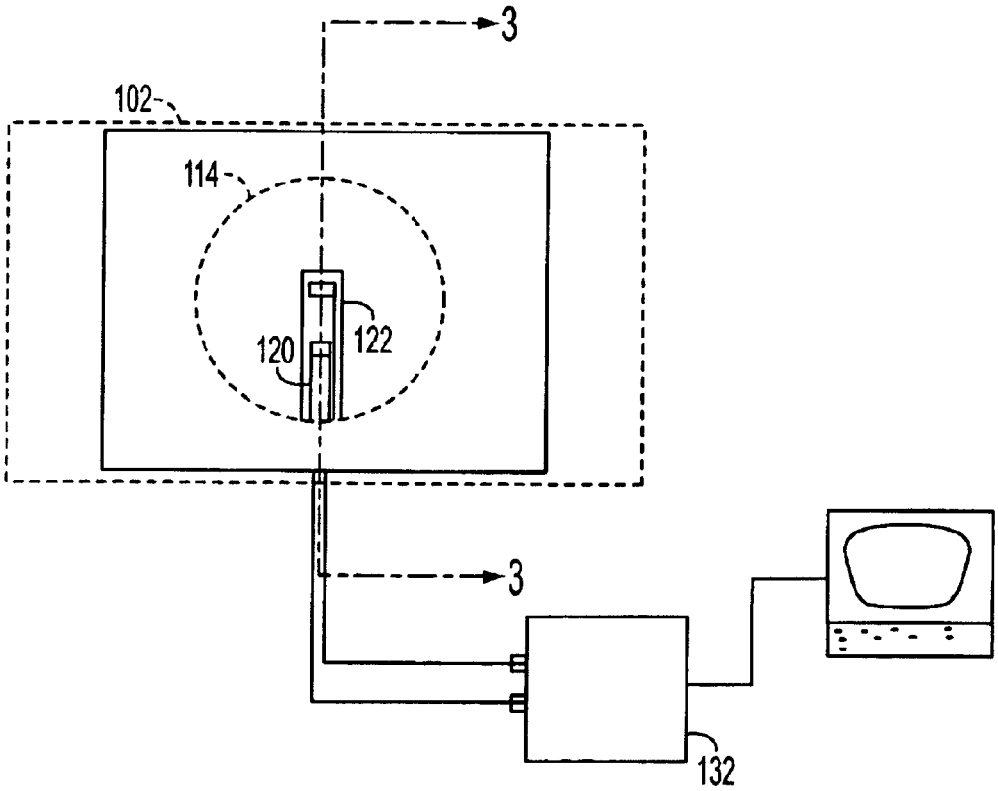
FIG. 3 is a diagram illustrating a cross-sectional top view of the exemplary CMP system of FIG. 4 and an exemplary control system for the endpoint detection system according to aspects of the present invention.
Figure 4:
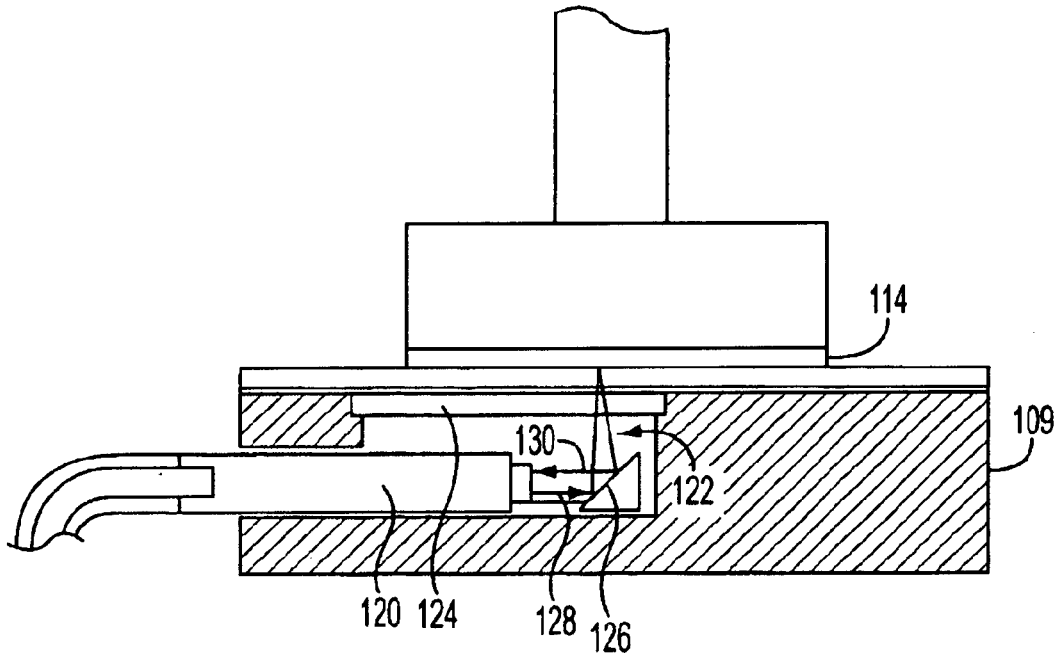
FIG. 4 is a diagram illustrating a cross sectional side view of the exemplary CMP system including the exemplary endpoint detection system of FIG. 2.

As illustrated in FIG. 3, in a plan view and also FIG. 4 in cross section, the monitoring device 120 is placed in a cavity 122 formed in the platen 109. As shown in FIG. 4, top of the cavity 122 can be sealed by a transparent window 124. In this embodiment, the cavity 122 is sized and shaped to accommodate movement of the elongate body of the monitoring device along the cavity 122. Position of the cavity 122 is correlated with the relative position of the wafer on the belt and the underlying platen. During the process, the monitoring device may be moved along the cavity by a moving mechanism (not shown) to scan the radius of the wafer. As a result of scanning action various locations between the edge of the wafer and the center of the wafer is monitored. The cavity could be extended beyond the center of the wafer so that a wide spectrum of reading can be done along, for example, the diameter of the wafer by sliding the monitoring device in the cavity so as to generate a scanning action, as the wafer is rotated.

In this embodiment, a mirror 126 attached to the monitoring device enables outgoing optical signal 128 to project on the wafer surface. The mirror 126 then allows incoming reflected optical signal 130 or reflected optical signal to reach the monitoring device 120. In alternative embodiments, using monitoring devices with different configurations, such as flexible micro fibers, may eliminate the use of a mirror, and the signals may be directly sent from the device to the copper surface. The device determines endpoint, that is, the instant that the barrier layer 18 is exposed (see FIG. 1B), when the intensity of the reflected signal 130 is abruptly changed. If the CMP process is continued to remove the barrier layer, the intensity of the reflected signal is again changed when the top surface 15 of the insulating layer 14 is exposed (see FIG. 1B). The optical signals generated by the monitoring device or directed by it may have wavelength range of 600–900 nanometers. The outgoing optical signal may be generated by an emitter of the device 120, such as a white light emitter with a chopper or a LED or laser. According to a presently preferred embodiment, the reflected optical signal is received by a detector of the device 120. An exemplary detector can be a pyroelectronic detector. Incoming optical signal may first pass through a bandpass filter set up to eliminate substantially all wavelengths but the one that is detected by the detector. In this embodiment, the outgoing and the reflected signals advantageously travels through the polishing belt which is optically transparent. Another alternative embodiment is to place an array of multiple monitoring devices fixed in the radially formed cavities extending from a center of the plate (star shape), which may correspond to the center of the wafer, to monitor the signal change on the wafer surface. Again, alternatively, a number of monitoring devices may be distributed along a single cavity. In this way, the monitoring devices may collect data from the center, middle, and edge areas of the rotating wafer surface.

According to an aspect of the present invention, the whole polishing belt is made of transparent materials and no extra window is needed for the endpoint detection. In this embodiment the belt comprises a composite structure having a top transparent abrasive layer formed on a transparent backing material. An abrasive layer contacts the workpiece during the process and includes fine abrasive particles distributed in a transparent binder matrix. An exemplary linear polishing belt structure used with the present invention may include a thin coating of transparent abrasive layer, for example 5 $\mu$m to 100 $\mu$m thick, stacked on a transparent Mylar backing, which material is available from Mipox, Inc., Hayward, Calif. The abrasive layer may be 5 $\mu$m to 100 $\mu$m thick while the backing layer may be 0.5 to 2 millimeter thick. Size of the abrasive particles in the abrasive layer are in the range of approximately 0.2–0.5 $\mu$m. An exemplary material for the particles maybe silica, alumina or ceria. A less transparent belt, but still usable with the present invention, is also available from 3M Company, Minnesota. While in some embodiments the belt can include abrasive particles, the belt can also be made of transparent polymeric materials without abrasive particles.

As described above, as the abrasive belt removes materials from the wafer surface and as the barrier layer or the oxide layer is exposed, the reflected light intensity changes. In one example, a transparent polishing belt having approximately 10 $\mu$m thick abrasive layer and 0.5–1.0 millimeter thick transparent Mylar layer was used. In this example, the abrasive layer had 0.2–0.5 $\mu$m fumed silica particles. A light beam (outgoing) of 675 nanometer wavelength was sent through this belt and the intensity changes throughout the CMP process were monitored. With this polishing belt, it was observed that throughout the copper removal process, the intensity of the reflected light kept an arbitrary (normalized) intensity value of 2. However, as soon as the barrier layer (Ta layer) was exposed the intensity value was reduced to 1. Further, when the barrier layer was removed from the top of the oxide layer and the oxide layer was exposed, the intensity of the reflected light was reduced to 0.5.

As shown in FIG. 3, in the preferred embodiment, the monitoring device 120 is connected to a computer 132, which computer may also be electrically connected to a carrier head controller (not shown), although it is understood that the computation could be performed in many manners, and need not necessarily require a computer with a processor, but instead could use discrete or integrated logic circuits, including but not limited to ASICS and programmable gate arrays. When operating on a copper layer with a barrier layer beneath, as soon as the barrier layer is exposed, the output signal from the monitoring device changes as a result of change in reflectivity, and the CMP process is halted.

In general, the endpoint detection apparatus and methods according to aspects of the present invention are applied to one or more workpieces to detect one or more endpoints on each workpiece. For example, a CMP endpoint detection process according to an aspect of the present invention might have several CMP endpoints to be detected for a single workpiece such as a wafer. The CMP endpoints can have respective polishing sequences and respective process conditions corresponding thereto. For example, removal of the metal overburden from the surface of the wafer might represent a first CMP endpoint, and removal of the barrier layer outside of the features of the wafer might represent a second CMP endpoint. A first threshold or level of signal intensity might be used to detect the first CMP endpoint so that when the signal intensity observed by the detection system drops to at or below the first threshold or level, the first CMP endpoint is determined to have been reached. Other thresholds or level of signal intensity might be used to detect other CMP endpoints. For example, for detecting a second CMP endpoint, when the signal intensity observed by the detection system drops to at or below a second threshold or level lower than that of the first threshold or level, the second CMP endpoint would be determined to have been reached.

It is to be understood that in the foregoing discussion and appended claims, the terms "workpiece surface" and "surface of the workpiece" include, but are not limited to, the surface of the workpiece prior to processing and the surface of any layer formed on the workpiece, including conductors, oxidized metals, oxides, spin-on glass, ceramics, etc.

Although various preferred embodiments have been described in detail above, those skilled in the art will readily appreciate that many modifications of the exemplary embodiment are possible without materially departing from the novel teachings and advantages of this invention.

What is claimed is:

1. A chemical mechanical polishing (CMP) apparatus for polishing a surface of a workpiece and for detecting a CMP endpoint, comprising:

an optically transparent polishing belt to polish the surface of the workpiece, the polishing belt being movable in one or more linear directions;

a workpiece holder to support the workpiece, the workpiece holder configured to press the workpiece against the polishing belt;

a support plate adapted to support the polishing belt as the workpiece is pressed against the polishing belt; and an optical detection system to detect the CMP endpoint, the optical detection system disposed below the polishing belt and comprising a light source and a detector, the light source sending outgoing signals through the polishing belt to the surface of the workpiece and the detector receiving incoming reflected signals from the surface of the workpiece through the polishing belt wherein the polishing belt is moved bi-directionally.

2. The apparatus according to claim 1, wherein the optically transparent polishing belt comprises a composite structure.

3. The apparatus according to claim 2, wherein the composite structure is comprised of a first transparent layer placed on a second transparent layer.

4. The apparatus according to claim 3, wherein the first transparent layer is an abrasive layer comprising abrasive particles distributed in a binder matrix.

5. The apparatus according to claim 4, wherein outgoing signals are a light beam in the wavelength range of 600–900 nanometers.

6. The apparatus according to claim 5, wherein the wavelength of the light beam is 675 nanometers.

7. The apparatus according to claim 1, wherein a cavity is defined in the support plate.

8. The apparatus according to claim 7, wherein the optical detection system is mounted within the cavity.

9. The apparatus according to claim 8, wherein a transparent window covers the cavity defined within the support plate, the optical detection system sending and receiving the respective incoming and outgoing signals through the transparent window.

10. The apparatus according to claim 8, wherein the optical detection system is configured to move within the cavity to permit detection of the CMP endpoint over the surface of the workpiece.

11. The apparatus according to claim 8, wherein the optical detection system comprises a plurality of detector devices distributed into a plurality of cavities formed in the support plate so as to monitor multiple areas on the surface of the workpiece.

12. The apparatus of claim 1, wherein the polishing belt uses a polishing solution to polish the surface of the wafer, wherein abrasive particles are dispersed within the polishing solution.

13. apparatus according to claim 1, wherein the polishing belt has a first end and second end and a polishing side and a backside and further comprising:

a receive area to which the first end of the polishing belt can be connected; and a supply area to which the second end of the polishing belt can be connected, wherein the support plate provides a path for the polishing belt to travel between the receive area and the supply area, such that a workpiece polishing area exists along the path.

14. A method of polishing a surface of a workpiece and of detecting a chemical mechanical polishing (CMP) endpoint, comprising:

pressing the workpiece against an optically transparent polishing belt, the polishing belt being supported by a support plate;

polishing the surface of the workpiece with the polishing belt, wherein the polishing belt is movable in one or more linear directions;

sending outgoing optical signals from a light source through the polishing belt to the surface of the workpiece, the light source disposed below the polishing belt so that the polishing belt is between the light source and the surface of the workpiece;

receiving, at a detector, incoming reflected optical signals from the surface of the workpiece through the polishing belt and the support plate, the detector disposed below the polishing belt; and moving the light source and the detector to permit detection of the CMP endpoint over the surface of the workpiece.

15. The method according to claim 14, wherein sending signals and receiving signals steps uses a light beam of 600–900 nanometers wavelength range.

16. The method according to claim 15, wherein the light beam has a wavelength of 675 nanometers.

17. A method of polishing one or more workpieces and of providing chemical mechanical polishing (CMP) endpoint detection, comprising:

providing an optically transparent polishing belt between a supply area and a receive area, the polishing belt having a first end and a second end and a polishing side and a backside, such that the first end initially comes off the supply area and is connected to the receive area and the second end remains connected to the supply area;

polishing a first workpiece by moving a portion of the polishing belt in one or more linear directions within a polishing area; and detecting a first CMP endpoint of the first workpiece using an optical detection system, the optical detection system sending outgoing signals to and receiving incoming reflected signals from the first workpiece through the polishing belt, the polishing belt being located between the optical detection system and the first workpiece.

18. The method according to claim 17, further comprising the step of introducing the first workpiece to the polishing area prior to polishing the first workpiece with the portion of the polishing belt.

19. The method according to claim 17, further comprising changing a set of process conditions for a polishing sequence corresponding to the first CMP endpoint of the first workpiece to a second set of process conditions for a second polishing sequence corresponding to a second CMP endpoint of the first workpiece when the first CMP endpoint is detected.

20. The method according to claim 19, wherein the first CMP endpoint corresponds to removal of a metal overburden layer from the first workpiece.

21. The method according to claim 20, wherein the second CMP endpoint corresponds to removal of a barrier layer from the first workpiece.

22. The method according to claim 17, further comprising the step of removing the first workpiece when the first CMP endpoint is detected.

23. A method of polishing a surface of a workpiece and of detecting a chemical mechanical polishing (CMP) endpoint, comprising:

supporting the workpiece such that the surface of the workpiece is exposed to a section of an optically transparent polishing belt in a processing area; and polishing the surface of the wafer by moving the section of the polishing belt bi-directional linearly; and determining a CMP endpoint for the workpiece by sending outgoing optical signals through the polishing belt to the workpiece and continuously examining the relative intensity of incoming optical signals reflected from the workpiece and received through the polishing belt.

24. A method according to claim 23, wherein the polishing belt is moved with a driving mechanism that generates the bi-directional linear movement.

25. A method according to claim 23, wherein the CMP endpoint occurs when an observed optical signal intensity reaches a first level, the CMP endpoint corresponding to removal of a metal overburden layer.

26. A method according to claim 25, wherein the step of determining is used to determine a second CMP endpoint for the workpiece.

27. A method according to claim 26, wherein the second CMP endpoint occurs when the observed optical signal intensity reaches a second level, the CMP endpoint corresponding to removal of a barrier layer.

28. The method according to claim 23, further comprising the step of advancing the polishing belt to obtain another portion that will be used for polishing.

29. The method according to claim 28, further comprising the steps of:

removing the first workpiece when the first CMP endpoint is detected, introducing a second workpiece to the polishing area; and polishing the second workpiece by moving the another portion of the polishing belt in one or more linear directions within the polishing area.

* * * * *